US008449350B2

(12) United States Patent
Pei

(10) Patent No.: US 8,449,350 B2
(45) Date of Patent: May 28, 2013

(54) SANDBLASTING APPARATUS AND METHOD FOR SHAPING PRODUCT WITH SAME

(75) Inventor: Shao-Kai Pei, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 394 days.

(21) Appl. No.: 12/958,398

(22) Filed: Dec. 2, 2010

(65) Prior Publication Data

US 2011/0312252 A1 Dec. 22, 2011

(30) Foreign Application Priority Data

Jun. 22, 2010 (TW) ..... 99120320 A

(51) Int. Cl.
*B24B 1/00* (2006.01)

(52) U.S. Cl.
USPC ..... 451/38; 451/29; 451/30; 451/39; 451/75; 451/102; 451/58; 451/69

(58) Field of Classification Search
USPC ..... 451/37, 38, 29, 30, 58, 69, 75, 102
See application file for complete search history.

(56) References Cited

U.S. PATENT DOCUMENTS 3,687,750 A * 8/1972 Jamieson ..... 156/63
3,837,881 A * 9/1974 Hix ..... 451/30
4,093,754 A * 6/1978 Parsons ..... 427/259
4,656,791 A * 4/1987 Herrington et al. ..... 451/38
4,703,591 A * 11/1987 Herrington et al. ..... 451/40
4,918,873 A * 4/1990 Bass ..... 451/38
5,052,155 A * 10/1991 Blacka et al. ..... 451/78
5,593,528 A * 1/1997 Dings et al. ..... 156/154
5,704,824 A * 1/1998 Hashish et al. ..... 451/36
5,709,587 A * 1/1998 Shaffer ..... 451/38
5,766,061 A * 6/1998 Bowers ..... 451/89
6,077,152 A * 6/2000 Warehime ..... 451/75
6,379,214 B1 * 4/2002 Stewart et al. ..... 451/2
6,416,390 B1 * 7/2002 Mezei et al. ..... 451/37
6,422,920 B1 * 7/2002 Bouten et al. ..... 451/29
7,153,186 B2 * 12/2006 Popescu et al. ..... 451/6
2002/0090892 A1 * 7/2002 Mezei et al. ..... 451/38
2003/0032369 A1 * 2/2003 Carpenter ..... 451/38

* cited by examiner

*Primary Examiner* — George Nguyen
(74) *Attorney, Agent, or Firm* — Altis Law Group, Inc.

(57) ABSTRACT

A sandblasting apparatus includes a processing chamber, a sandblasting nozzle positioned on a top of the processing chamber, a support mechanism, an elevation mechanism, a worktable, and a cutting mechanism. The support mechanism is positioned in the processing chamber and opposite to the sandblasting nozzle. The support mechanism is used for supporting a template with a cutting pattern. The elevation mechanism is positioned on the bottom of the processing chamber. The worktable is located between the support mechanism and the elevation mechanism and configured for supporting a plate for processing and being opposite to the template. The center of worktable defines a through hole matching with the pattern of the template. The cutting mechanism is fixed on the elevation mechanism and faces the through hole. The elevation mechanism drives the cutting mechanism to move toward or away the worktable.

11 Claims, 7 Drawing Sheets

SANDBLASTING APPARATUS AND METHOD FOR SHAPING PRODUCT WITH SAME

BACKGROUND

1. Technical Field

The disclosure relates to sandblasting technology, and particularly to a sandblasting apparatus.

2. Description of the Related Art

A milling roller is often used to process a glass sheet into a circular piece, after which the sheet is cut into a plurality of spare pieces similar to the size of the circular glass. UV light is used to cure UV-sensitive glue for attaching the plurality of pieces. The milling roller then shapes the pieces, and suitable cleaner removes the UV glue. Thus, the glass can be separated and fabrication is complete.

However, excess UV glue often remains on the glass, sullying the surface thereof.

Accordingly additional cleaning process is required, increasing costs and time consumed. Moreover, processing as described is complicated and difficult to automate. As a result, yield is low.

Therefore, it is desirable to provide an apparatus which can overcome the described limitations.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present sandblasting apparatus. Moreover, in the drawings, like reference numerals designate corresponding parts throughout the views.

DETAILED DESCRIPTION

Embodiments of a sandblasting apparatus as disclosed are described in detail here with reference to the drawings.

Figure 1:
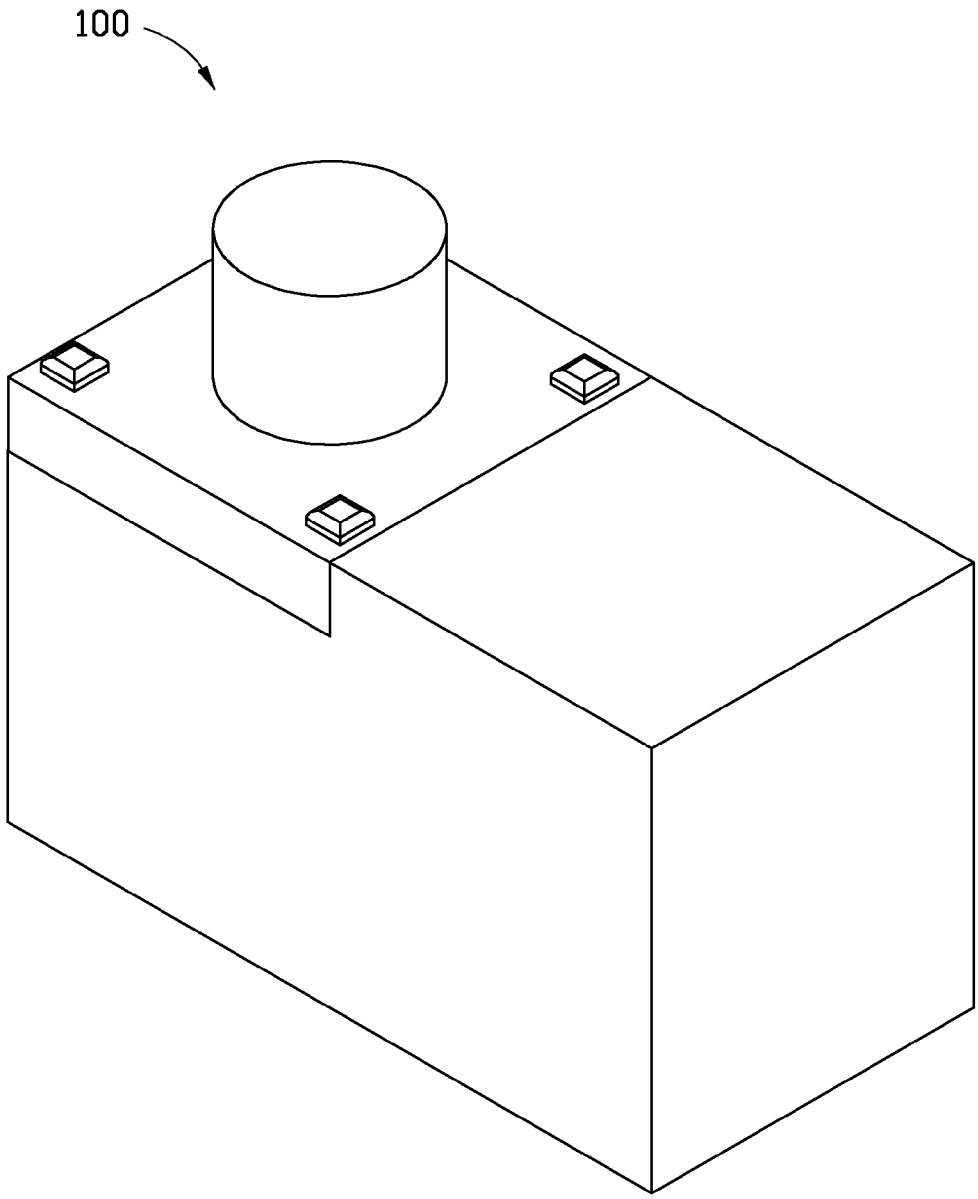
FIG. 1 is a schematic view of a sandblasting apparatus in accordance with a first embodiment.
Figure 2:
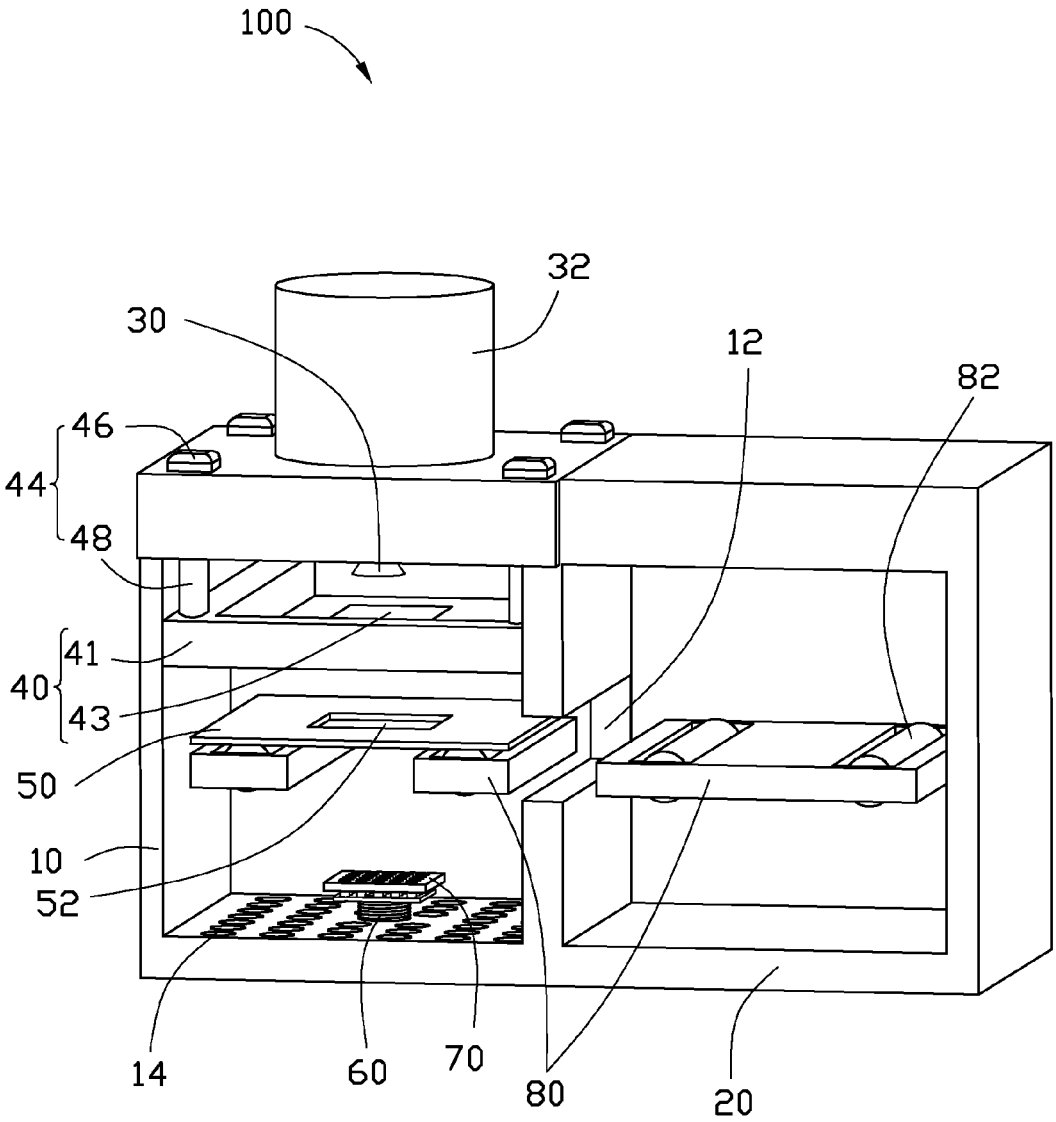
FIG. 2 is a schematic view of an internal structure of the sandblasting apparatus of FIG. 1.

Referring to FIGS. 1 and 2, a sandblasting apparatus 100 includes a processing chamber 10, a preparation chamber 20, a sandblasting nozzle 30, a support mechanism 40, a worktable 50, an elevation mechanism 60, a cutting mechanism 70, and a transport mechanism 80.

The processing chamber 10 connects to the preparation chamber 20, both of which are separately formed of sheets.

The processing chamber 10 houses sandblasting process. The preparation chamber 20 arranges a processing sheet and a product. The transport mechanism 80 transports the processing sheet and the product. A through hole 12 is arranged between the processing chamber 10 and the preparation chamber 20 in this embodiment.

Preferably, the processing chamber 10 and the preparation chamber 20 are closed chambers, such that particulate material used during sandblasting is contained.

The sandblasting nozzle 30 is arranged on the top of the processing chamber 10, emitting grit at high speeds to form a cut pattern. The angle of the sandblasting nozzle 30 can be adjusted. The size of the sandblasting nozzle 30 exceeds the size of the processing sheet.

Figure 5:
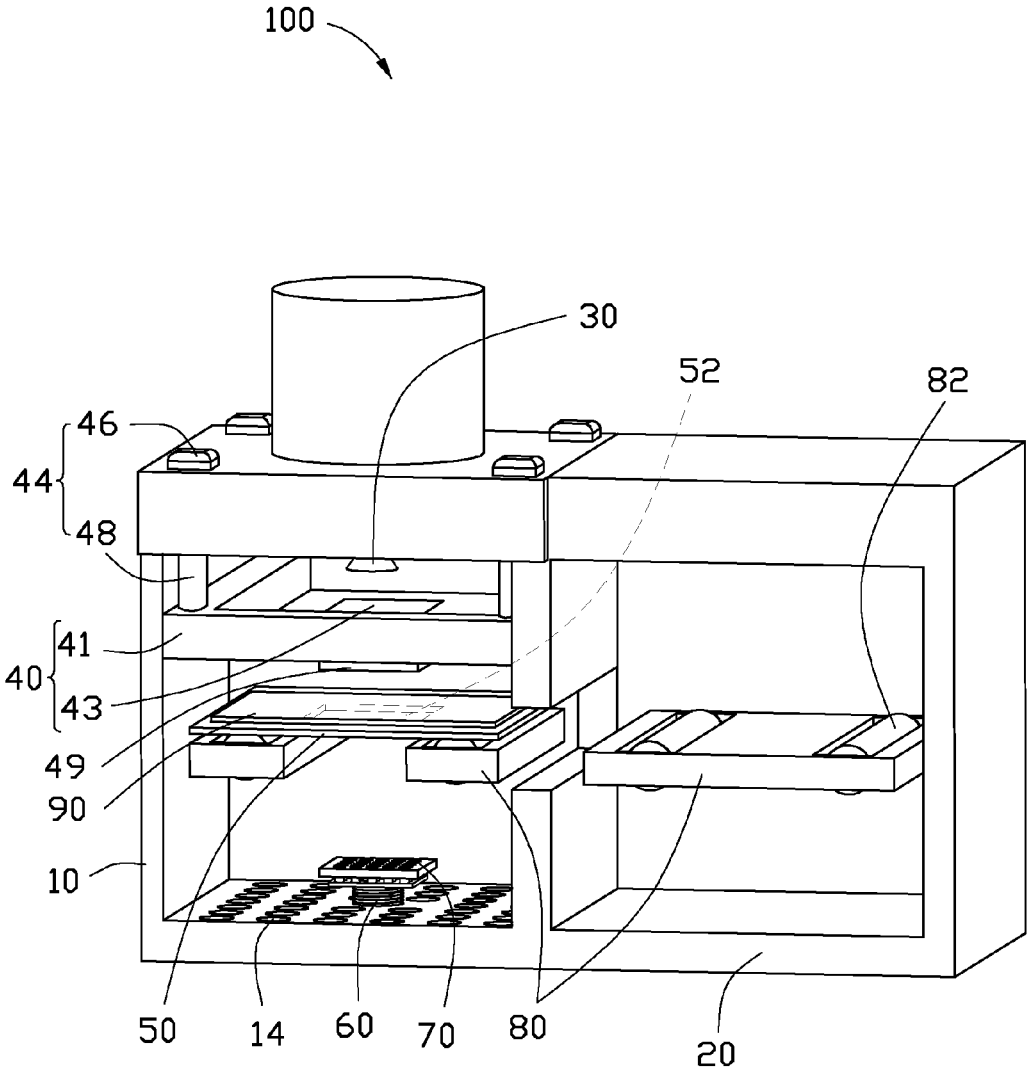
FIG. 5 is a schematic view of a glass sheet and a template arranged in the sandblasting apparatus of FIG. 2.

The sandblasting nozzle 30 connects to a working unit 32, consisting of a pressure tank, a working valve, a solenoid valve, a de-pressure valve, a vacuum pump, a filter, an air system, and a circuit system (not shown), whereby the sandblasting nozzle 30 can perform the required mechanical processing to the processing sheet, which is a glass sheet 90 in FIG. 5 of the present disclosure.

The sandblasting nozzle 30 is not limited to that disclosed. According to need, the sandblasting nozzle 30 can be replaced by other nozzle or spray gun.

Furthermore, a plurality of suction holes 14 is arranged on the bottom of the processing chamber 10, by which expended grit can be evacuated from the chamber for recycling.

Further, the plurality of suction holes 14 can be sealed to maintain the closed state of the processing chamber 10 and the preparation chamber 20 during sandblasting.

Figure 6:
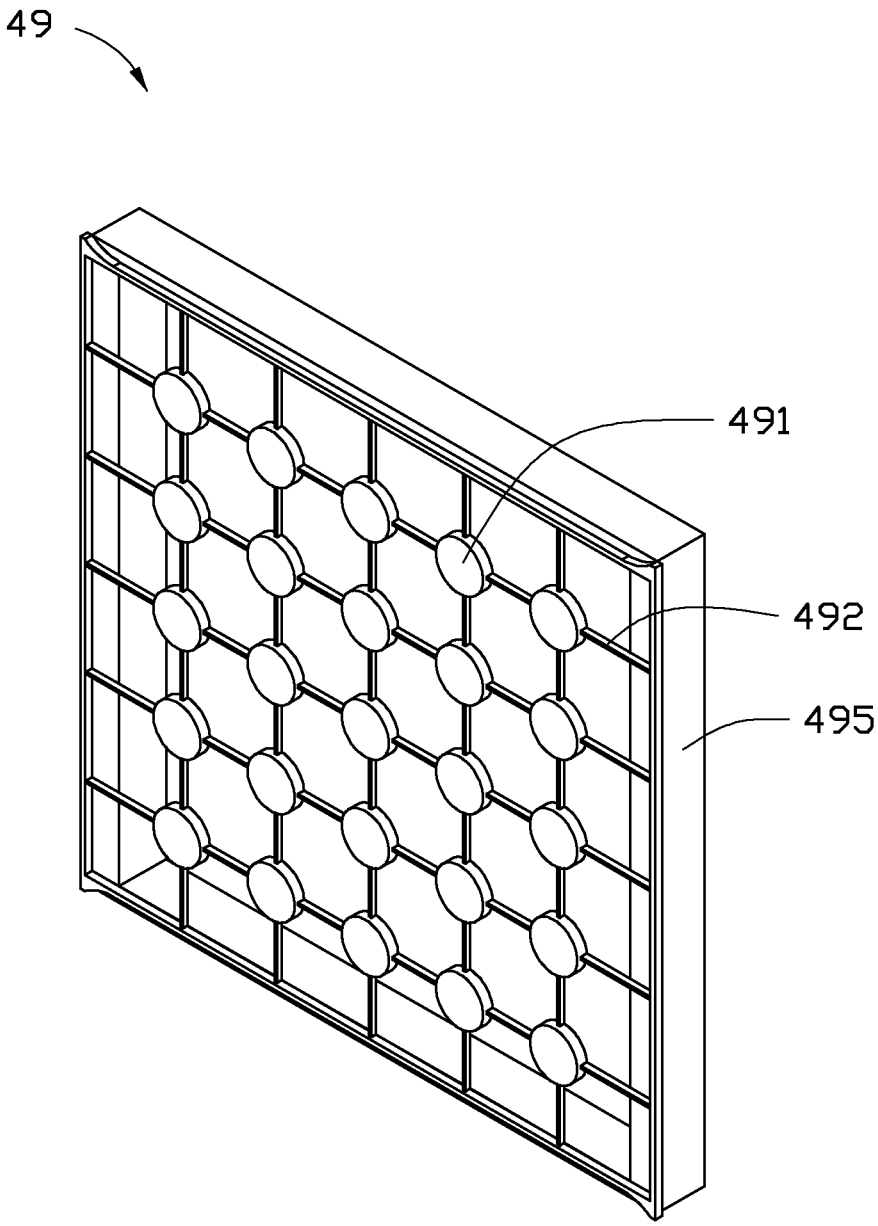
FIG. 6 is a schematic, enlarged view of the template of FIG. 5.

Referring to FIGS. 2 and 5, the support mechanism 40 arranged inside the processing chamber 10 is below and faces the sandblasting nozzle 30. The support mechanism 40 supports the template 49 with a cutting pattern. (as shown in FIGS. 5 and 6). The sandblasting with high velocity from the sandblasting nozzle 30 can manufacture the products with a pattern corresponding to the cutting pattern of the template 49. In this embodiment, the support mechanism 40 includes a connection plate 41 and a supporting hole 43. The connection plate 41 includes a rectangular bottom plate (not labeled) and a frame (not labeled) extending upwardly from a periphery of the rectangular bottom plate. The supporting hole 43 is arranged on the bottom plate of the connection plate 41 and located at the center of the connection plate 41 and faces the sandblasting nozzle 30. A bottom of the bottom plate of the connection plate 41 supports the template 49 below the supporting hole 43.

Referring to FIG. 5, the worktable 50 is arranged inside the processing chamber 10 and located below and faces the support mechanism 40. The worktable 50 supports the glass sheet 90 facing the template 49.

In this embodiment, a perpendicular through hole 52 is defined at the center of the worktable 50, facing the supporting hole 43 of the support mechanism 40. The size of the through hole 52 corresponds to the size of pattern area of the template 49 and the supporting hole 43. The cutting mechanism 70 is below the worktable 50. The cutting mechanism 70 passes through the through hole 52 and cuts the semi-finished product obtained from the glass sheet 90 to obtain the finished product.

Furthermore, the support mechanism 40 connects to a driving mechanism 44. The driving mechanism 44 drives the support mechanism 40 up and down relative to the worktable 50. In this embodiment, the driving mechanism 44 has four motors 46 and four connection axes 48. The four motors 46 are arranged on the top of the processing chamber 10. One end of the connection axis 48 connects to the motor 46, and the other end of the connection axis 48 connects to the connection plate 41 of the support mechanism 40. Thus, by the four motors 46, the driving mechanism 44 drives the support mechanism 40 up and down relative to the worktable 50, whereby the template 43 with a cutting pattern defined therein can be conveniently located on the glass sheet 90.

The motor 46 and the connection axis 48 can connect by mechanical transmission, such as a gear.

Figure 3:
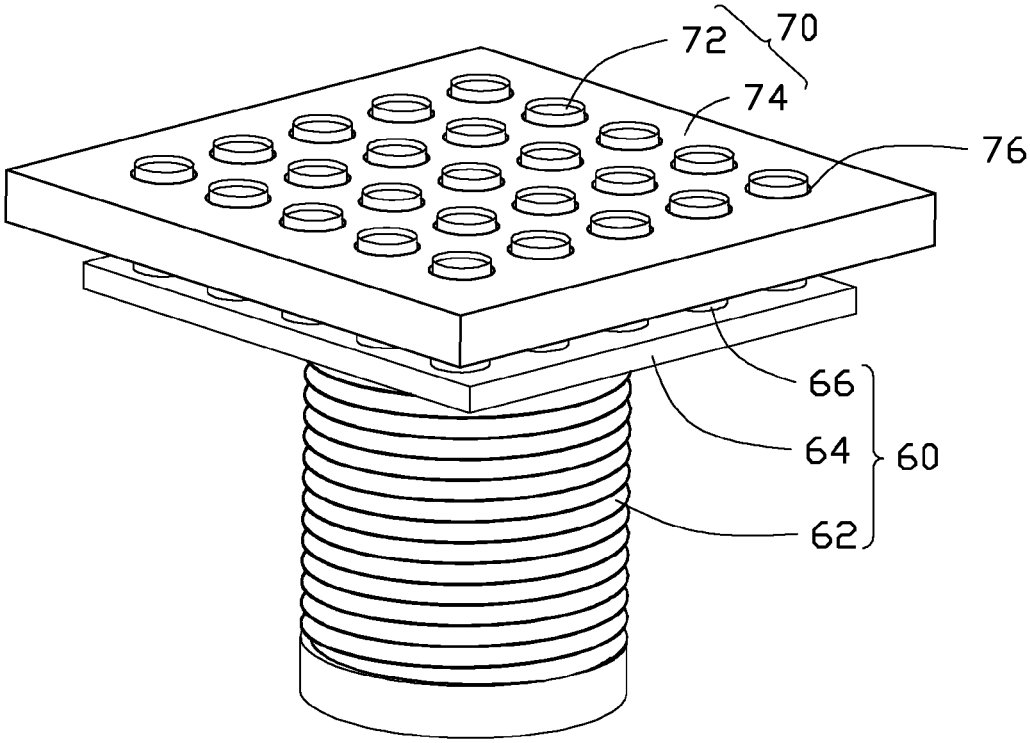
FIG. 3 is a schematic, enlarged view of an elevation mechanism and a cutting mechanism of the sandblasting apparatus of FIG. 2.

Referring to FIGS. 2 and 3, the elevation mechanism 60 is arranged inside the processing chamber 10 and below the through hole 52 of the worktable 50 and faces the worktable 50. The cutting mechanism 70 is fixed on the elevation mechanism 60 and faces the worktable 50. The cutting mechanism 70 cuts the semi-finished product obtained from the glass sheet 90 to obtain the desired product. After the glass sheet 90 is processed by the sandblasting nozzle 30 to obtain the semi-complete product, the cutting mechanism 70 passes through the through hole 52 of the worktable 52 and cuts the excess material of the semi-complete product on the worktable 50. Thus, the finished product is completed.

In this embodiment, the elevation mechanism 60 includes a telescoping apparatus 62, a push plate 64 and a plurality of pushrods 66. The cutting mechanism 70 includes a plurality of cutters 72 and a knife rest 74. The telescoping apparatus 62 connects to the push plate 64. The plurality of pushrods 66 is arranged on the push plate 64. The knife rest 74 has a plurality of knife holes 76 corresponding to a cutting pattern of the template 49. Each cutter 72 connects to one pushrod 66 and is through the knife hole 76. When the telescoping apparatus 62 extends, the telescoping apparatus 62 drives the push plate 64 and the pushrods 66 upward. Thus, the cutters 72 move upward and cut. When the telescoping apparatus 62 reverses to the original state, the push plate 64, the pushrods 66 and the cutters 72 move downward.

In this embodiment, the telescoping apparatus 62 is a retractable spring mechanism consisting of a magnetic tube and a spring on the magnetic tube. Thus, by electromagnetic control, the telescoping apparatus 62 can extend and retract.

The elevation mechanism 60 is not limited to this embodiment. The telescoping apparatus 62 can be telescopic rod, hydraulic device or pneumatic device. Thus, the cutting mechanism 70 can cut by the telescopic rod, the hydraulic device, or the pneumatic device.

Referring to FIG. 2, the transport mechanism 80 through the through hole 12 between the processing chamber 10 and preparation chamber 20 is arranged on side walls of the processing chamber 10 and preparation chamber 20. The transport mechanism 80 transmits the glass sheet 90 and product between the processing chamber 10 and preparation chamber 20.

In this embodiment, the transport mechanism 80 has four rollers 82 parallel mutually. Each roller 82 rotates around an axis by itself. Two rollers 82 are respectively arranged on the processing chamber 10 and the preparation chamber 20. The two rollers 82 of the processing chamber 10 are arranged below the worktable 50 and support the worktable 50.

By the four rollers of the transport mechanism 80, the glass sheet 90 and the worktable 50 can be transferred from the preparation chamber 20 to the processing chamber 10 and vice versa.

The worktable 50 is fixed on the two rollers 82 of the processing chamber 10 during processing by, for example, magnetic force. Thus, that ensures the position of the glass sheet 90 does not shift during the processing thereof.

After removing the excess material, the product is completed. By the transport mechanism 80, the processed glass sheet 90 can be replaced by a new glass sheet 90 for a new manufacturing process.

Figure 4:
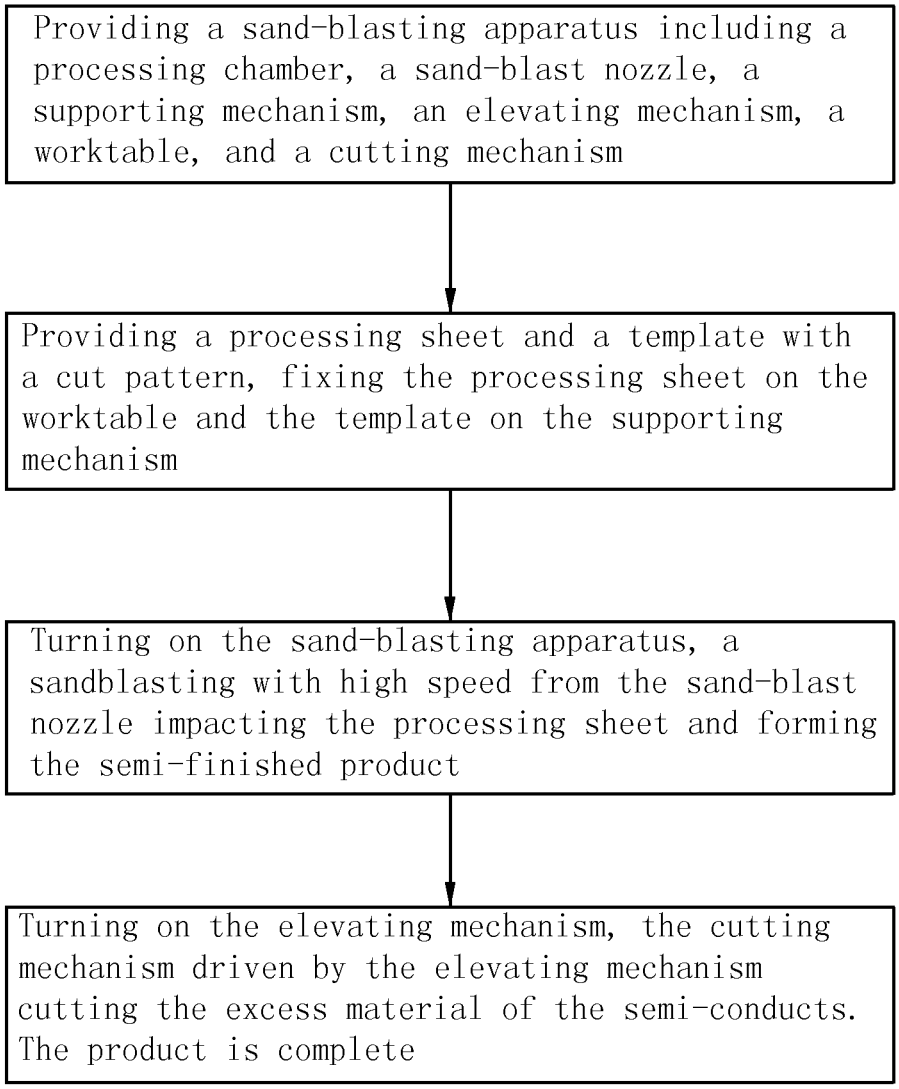
FIG. 4 is a flowchart of a processing method in accordance with a first embodiment.

FIG. 4 shows a method for processing product by the sandblasting apparatus 100 as follows.

First, provide the sandblasting apparatus 100 to manufacture the products with a cutting pattern.

Second, referring to FIG. 5, provide a glass sheet 90 and a template 49 with a cutting pattern. Turn on the transport mechanism 80. The glass sheet 90 is transmitted to the processing chamber 10 and fixed on the worktable 50. Adjust and fix the worktable 50 below the support mechanism 40. The template 49 is fixed on the bottom plate of the connection plate 41 of the support mechanism 40 below the supporting hole 43.

Referring to FIG. 6, the template 49 with a cutting pattern is a shape of the semi-complete product. In this embodiment, the template 49 includes a plurality of product portions 491, and a plurality of connection portions 492 connected to the product portions 491. The product portion 491 corresponds to the product, and the connection portion 492 corresponds to excess materials of the product.

Referring to FIG. 6, provide a fixing frame 495 matching with the support mechanism 40. The template 49 is fixed on the fixing frame 495. By the fixing frame 495, it is convenient to put the template 49 on the support mechanism 40 below the supporting hole 43.

Turn on the motor 46 of the driving mechanism 44, and drive the support mechanism 40, and then drive the template 49 moving toward the worktable 50. The template 49 covers the glass sheet 90.

Figure 7:
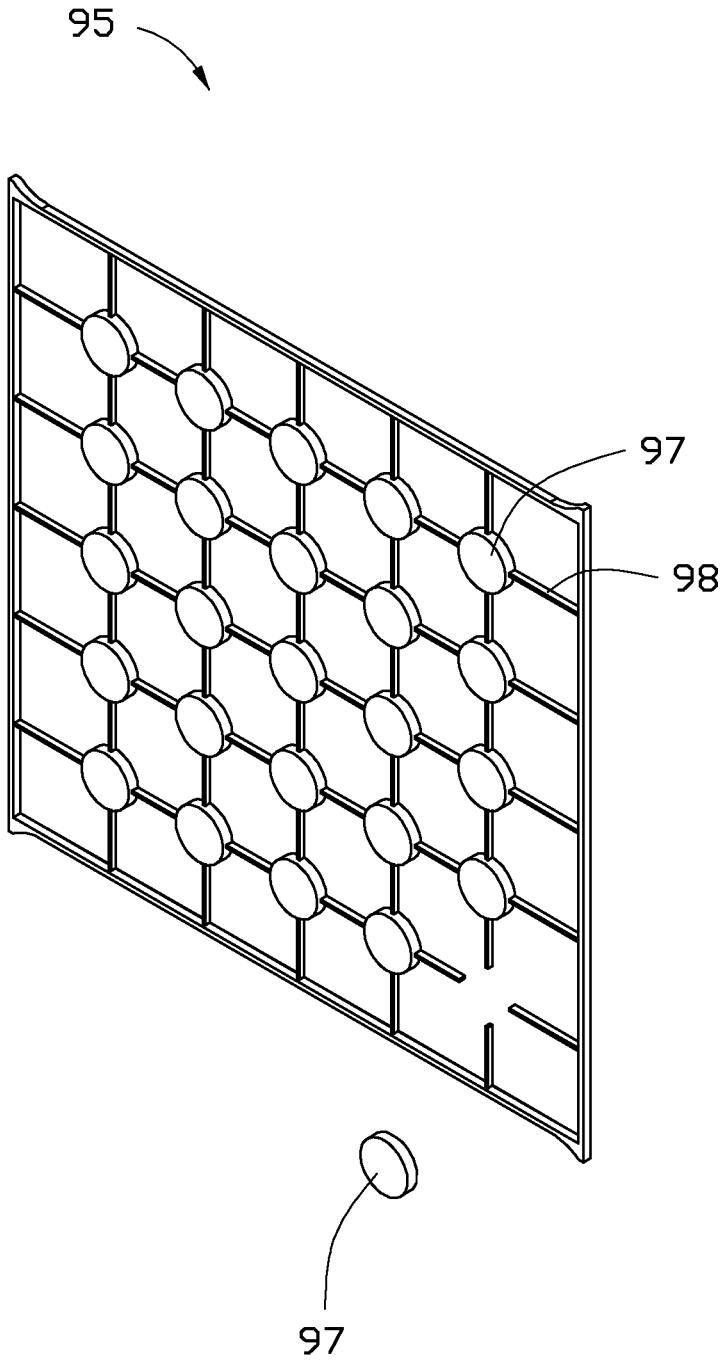
FIG. 7 is a schematic view of a semi-complete product and a completed product of the processing method of FIG. 4.

Third, turn on the sandblasting nozzle 30 of the sandblasting apparatus 100. The sandblasting with high speed from the sandblasting nozzle 30 shoots toward the template 49 and the glass sheet 90, and impacts the glass sheet 90 through the gap of the template 49. Thus, the sandblasting process fabricates the glass sheet 90 in according with the cutting pattern of the template 49 and forms the semi-complete product 95. Referring to FIG. 7, the semi-complete product 95 includes a product 97 and an excess material 98 connected to the product 97.

Preferably, the material of the template 49 is stainless steel. That ensures the template 49 can bear the impact force of the sandblasting.

After impacting the glass sheet 90, the major sandblasting falls to the bottom of the processing chamber 10 through the through hole 52 of the worktable 50. The major sandblast drains from the processing chamber 10 by the suction hole 14.

Fourth, referring to FIG. 7, after the semi-complete product 95 is formed, stop the sandblasting nozzle 30 of the sandblasting apparatus 100. Turn on the elevation mechanism 60 of the sandblasting apparatus 100. The telescoping apparatus 62 of the elevation mechanism 60 extends upwardly. The cutting mechanism 70 upwardly moves through the through hole 52 of the worktable 50. By the pushrods 66 and the cutters 72, the cutters 72 cut the excess material 98 of the semi-complete product 95. Thus, the finished products 97 are completed.

In order to cut easily the excess material 98 of the semi-complete product 95, the size of the excess material 98 corresponding to the connection portion 492 of the template 49 can be smaller than the size of the product 97. For example, the diameter of the product 97 is 3 mm, and the size of the excess material 98 corresponding to the connection portion 492 of the template 49 is smaller or equal to 0.5 mm.

The glass sheet 90 is not limited to glass, and can be plastic.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A sandblasting apparatus, comprising:

a processing chamber;

a sandblasting nozzle arranged on a top of the processing chamber;

a support mechanism arranged inside the processing chamber and opposite to the sandblasting nozzle for supporting a template with a predetermined pattern and moving the template downwardly or upwardly relative to the top of the processing chamber;

an elevation mechanism arranged at the bottom of the processing chamber;

a worktable arranged between the support mechanism and the elevation mechanism for supporting a plate for processing and being opposite to the template, wherein the center area of the worktable has a through hole corresponding to the pattern area of the template and a cutting mechanism fixed on the elevation mechanism facing the through hole of the center area of the worktable, and the elevation mechanism drives the cutting mechanism moving toward or away from the worktable.

2. The sandblasting apparatus of claim 1, wherein the elevation mechanism includes a telescoping device, a push plate, and a plurality of pushrods; the cutting mechanism includes a plurality of cutters and a knife rest; one end of the telescoping device connects to the bottom of the processing chamber, the other end connects to the push plate, the plurality of pushrods is arranged on the push plate and faces the worktable; the knife rest has a plurality of knife holes corresponding to the predetermined pattern of the template, each cutter connects to one pushrod through the one knife hole, the telescoping device drives the cutters moving upward to cut a processing sheet by the push plate and the pushrod.

3. The sandblasting apparatus of claim 1, further including a preparation chamber connected to the processing chamber and a transport mechanism arranged at the sidewalls of the preparation chamber and the processing chamber for transmitting the processing sheet between the preparation chamber and the processing chamber.

4. The sandblasting apparatus of claim 3, wherein the transport mechanism has a plurality of rollers parallel mutually and arranged inside the processing chamber and the preparation chamber, and the processing sheet is transmitted between the processing chamber and the preparation chamber by the rollers.

5. The sandblasting apparatus of claim 1, wherein the support mechanism includes a connection plate and a supporting hole, the template being secured to the connection plate below the supporting hole, the connection plate is formed by a bottom plate and a frame surrounding the bottom plate, the supporting hole is arranged at the bottom plate of the connection plate and located on a center area of the bottom plate of the connection plate facing the through hole of the worktable.

6. The sandblasting apparatus of claim 1, further including a driving mechanism arranged on the top of the processing chamber and connected to the support mechanism for driving the support mechanism to move relative to the worktable.

7. The sandblasting apparatus of claim 1, wherein a plurality of suction holes is arranged on the bottom of the processing chamber.

8. A method for processing, including steps:

providing a sandblasting apparatus including a processing chamber, a sandblasting nozzle, a support mechanism, an elevation mechanism, a worktable, and a cutting mechanism, wherein the sandblasting nozzle is arranged on the top of the processing chamber, the support mechanism is arranged inside the processing chamber and faces the sandblasting nozzle, the support mechanism supports the template with a cut pattern, the support mechanism elevates relative to the top of the processing chamber, the elevation mechanism is arranged on the bottom of the processing chamber, the worktable is arranged between the support mechanism and the elevation mechanism, the worktable supports the processing sheet facing the template, the center area of the worktable has a through hole corresponding to the size of pattern area of the template, the cutting mechanism is fixed on the elevation mechanism and faces the through hole of the center area of the worktable, the elevation mechanism drives the cutting mechanism moving toward or away from the worktable;

providing the processing sheet and the template with a cut pattern, the processing sheet is fixed on the worktable, and the template is fixed on the support mechanism; turning on the sandblasting apparatus, the sandblasting with high speed from the sandblasting nozzle impact the proceeding sheet, and forms a semi-complete product; and turning on the elevation mechanism, the cutting mechanism driven by the elevation mechanism cuts the excess material of the semi-complete product.

9. The method for processing of claim 8, wherein the sandblasting apparatus further includes a preparation chamber connected to the processing chamber and a transport mechanism arranged at the sidewalls of the preparation chamber and the processing chamber, the transport mechanism transmits the processing sheet between the preparation chamber and the processing chamber, and the processing sheet is fixed on the worktable.

10. The method for processing of claim 8, wherein the sandblasting apparatus further includes a driving mechanism arranged on the top of the processing chamber and connected to the support mechanism, the driving mechanism drives the support mechanism elevating and moving the template of the support mechanism toward the worktable to cover the processing sheet.

11. The method for processing of claim 8, wherein the material of the template is stainless steel.

* * * * *